US005176468A

United States Patent [19]

Poole

[11] Patent Number: 5,176,468

[45] Date of Patent: Jan. 5, 1993

[54] SHORELINE EROSION CONTROL AND REFURBISHING MEANS

[76] Inventor: Robert R. Poole, 6057 Sharpe Store Rd., Elm City, N.C. 27822

[21] Appl. No.: 886,829

[22] Filed: May 22, 1992

[51] Int. Cl.[5] ..... E02B 3/04

[52] U.S. Cl. ..... 405/23; 405/25; 405/21; 405/111

[58] Field of Search ..... 405/21, 23, 25, 30, 405/31, 32, 33, 110, 111, 115, 203, 208, 224

[56] References Cited

U.S. PATENT DOCUMENTS

| | | | |
|---|---|---|---|
| 2,014,116 | 9/1935 | Powers | 405/23 |
| 3,490,239 | 1/1970 | Vincent | 405/31 |
| 4,118,937 | 10/1978 | Mansen | 405/30 |
| 4,692,060 | 9/1987 | Jackson | 405/115 |

FOREIGN PATENT DOCUMENTS

| | | | |
|---|---|---|---|
| 1027317 | 7/1983 | U.S.S.R. | 405/23 |
| 1523623 | 11/1989 | U.S.S.R. | 405/31 |

*Primary Examiner*—Randolph A. Reese
*Assistant Examiner*—Arlen L. Olsen
*Attorney, Agent, or Firm*—John G. Mills and Associates

[57] ABSTRACT

This invention is an erosion control device in the form of a plurality of nestled, triangular-in-cross-section modules forming units. These units can be interconnected to form erosion control device of any desired length. These erosion control and refurbishing devices are preferably made from recycled plastic and can be sand colored to blend with the natural scenery. They also will not harm the environment nor injure people who come into contact with the same.

17 Claims, 3 Drawing Sheets

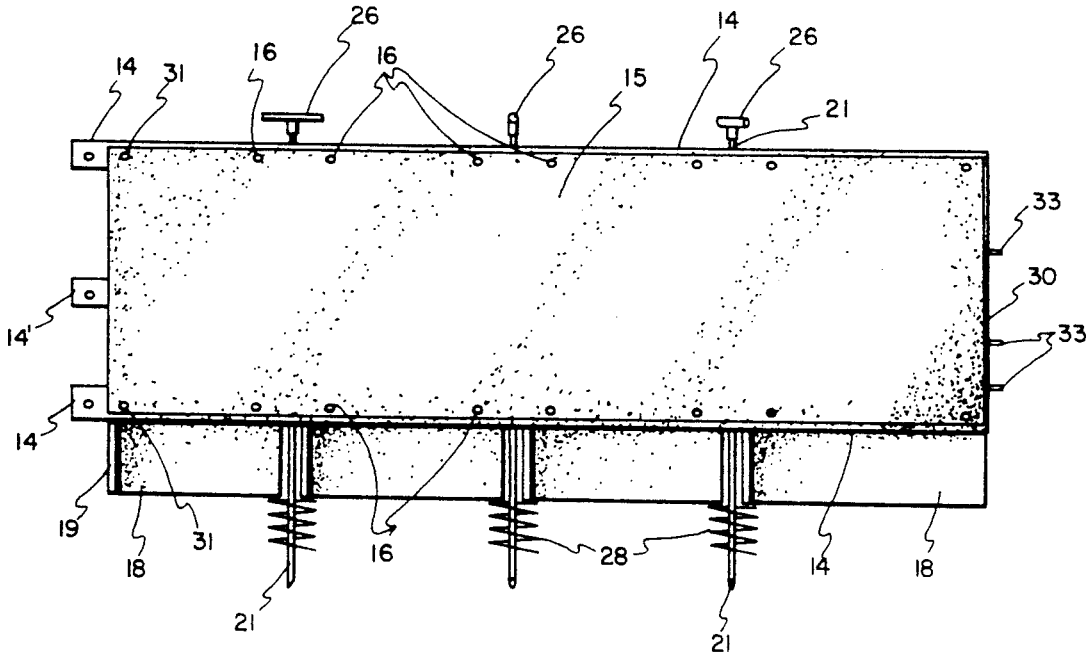
FIG. 6
FIG. 7
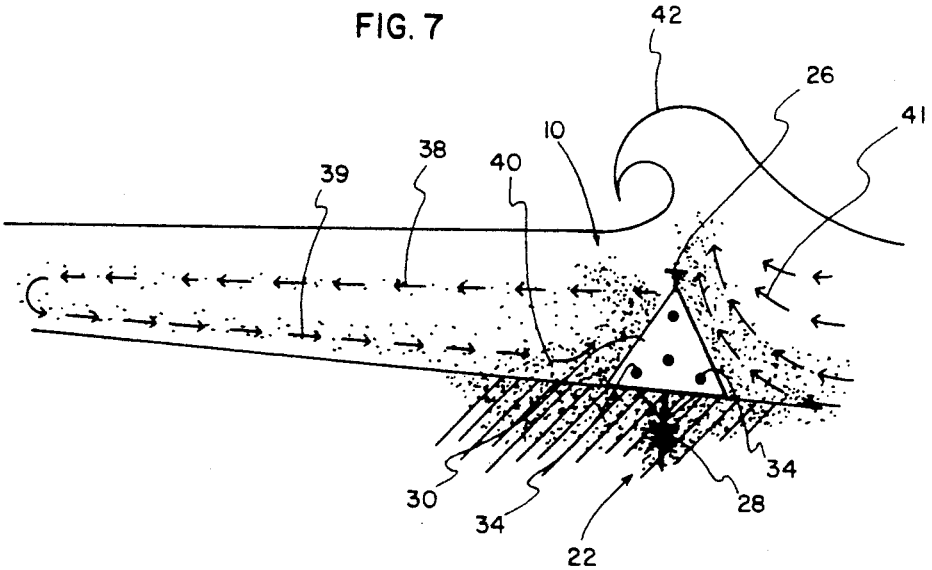

SHORELINE EROSION CONTROL AND REFURBISHING MEANS

FIELD OF INVENTION

This invention relates to shore protection and more particularly to shoreline erosion control and refurbishing means.

BACKGROUND OF INVENTION

Since man first began to settle on the shores of bodies of water and realized that such shores were eroding, efforts have been made to either slow down, stop or reverse the process. Jetties or groins extending out into the body of water have been built since ancient times to control the effects of tides and currents.

With the recent influx of people to coastal areas and the resulting great increase in the land values in such areas, erosion control and shoreline refurbishing has become an increasingly important subject. This is particularly true when coupled with the environmental issues raised by the construction of jetties, groins and sea walls as well as the large scale pumping of sand in attempts to refurbish and maintain beaches.

BRIEF DESCRIPTION OF INVENTION

After much research and study into the above mentioned problems, the present invention has been developed to provide not only and erosion control means for preventing the loss of sand and soils, but also means that actually causes the shoreline to refurbish itself.

This is accomplished by providing triangular-in-cross-section modules which are nestled one inside the other to form a strong yet relatively lightweight unit.

A plurality of these units can be connected together end to end to form a line of control and refurbishing means of any desired length.

Stabilizing fins are provided on the bottom of the units which have a depth equal to approximately one fourth the height of the side of the unit. Also, a plurality of auger type anchoring means are provided which pass through the units and hold the same in place as well as securing the triangle-in-cross-section modules relative to each other.

The exterior modules forming the unit are preferably sand colored so that they readily blend with the surrounding natural areas.

The string of modules can be assembled on shore, have end caps placed thereon and floated to the desired use location. At that point flap valves are opened to allow water and sand to pass into the interior of the units while trapping the same inside once it has entered the means.

The shoreline erosion control and refurbishing means of the present invention is preferably disposed under water at a depth of one half the height of the unit. If the waters are tidal, this depth would be at mean low tide.

The present invention can also be used as an inner sea wall which will be effective against wind erosion as well as water erosion at unusually high tides and from storm surges.

DISCUSSION OF PRIOR ART

The following references represent the closest prior art of which the inventor is aware:

U.S. Pat. No. 810,630 to Dwight is a beach making device that is triangular shaped in cross section. This Patent is not an equilateral triangle in cross section, however, and differs substantially from the present invention in that it is constructed of wood, has a longitudinal opening in one side thereof and has cross bracing periodically rather than a separate reinforcing triangle-in-cross-section module for strengthening the entire outer wall surface of the assembled unit.

U.S. Pat. No. 3,913,333 to Hubbard, Jr. discloses a means and apparatus for controlling fluid currents and effectively preserving and modifying topography subjected thereto. This Patent discloses hanger pins shown at 26 and land anchors or pilings 22 to secure the apparatus. This reference does not disclose nor suggest auger type anchoring means and is entirely different in structure and material of construction from the present invention.

U.S. Pat. No. 4,502,816 to Creter, Jr. et al is considered of interest in that it discloses a triangular shaped shoreline breakwater but there the similarity ends. This reference is manufactured from reinforced concrete and uses its own weight to form an artificial reef.

U.S. Pat. No. 3,653,216 to Stickler, Jr. discloses a method and apparatus for preventing erosion wherein a plurality of quonset type huts are connected end to end along a beach. This reference is constructed of reinforced concrete and does not otherwise anticipate the present invention.

U.S. Pat. No. 4,818,141 to Rauch is noted because a plurality of units are placed end to end. Again, this is manufactured from prefabricated concrete rather than plastic and does not contain the various features included in the present invention.

U.S. Pat. No. 4,776,725 to Brade shows an erosion control apparatus manufactured from reinforced concrete. The pertinency of this reference is that a plurality of units can be interconnected as shown clearly in FIG. 1. Beyond this, the reference is considered of general interest only.

Finally, U.S. Pat. No. 4,790,685 to Scott et al discloses a shoreline breakwater for coastal waters with triangular shaped modules 10 formed from rubber of a medium hard durometer and is used for forming a beach which, if desired, at low tide can be shifted inwardly by earth moving equipment. This reference does not teach an equilateral triangle, nor does it include other internal features of the present invention, nor the method of placing and anchoring such invention.

OBJECTS OF INVENTION

In view of the above, it is an object of the present invention to provide a shoreline erosion control and refurbishing means that includes at least two elongated, equilateral triangle-in-cross-section modules adapted to have one disposed within the other and are locked together by auger type anchor means.

Another object of the present invention is to provide a shoreline erosion control and refurbishing means constructed from recycled plastic and colored to blend with the surrounding natural environment.

Another object of the present invention is to provide a generally equilateral triangle-in-cross-section shoreline erosion control and refurbishing means which includes a stabilizing fin on the lower portion thereof having a depth equal to approximately one quarter of the height of the sides.

Another object of the present invention is to provide equilateral triangle-in-cross-section shoreline erosion control and refurbishing units which can be assembled on shore and floated to their designated use area.

Another object of the present invention is to provide a shoreline erosion control and refurbishing means including a plurality of generally equilateral triangle-in-cross-section units that are shore line assembled, floated to their use position, and are anchored to the bottom with auger type anchors.

Another object of the present invention is to provide a plurality of generally equilaterally triangle-in-cross-section shore line refurbishing units which are disposed on shore to form an inner sea wall for controlling wind erosion as well as water erosion during unusually high tides and during storm surges.

Another object of the present invention is to provide shoreline erosion control and refurbishing means which have flap valves in the end walls thereof to allow the ingress of water and sand while preventing the egress thereof.

Other object and advantages of the present invention will become apparent and obvious from the study of the following description and the accompanying drawings which are merely illustrative of such invention.

BRIEF DESCRIPTION OF DRAWINGS

FIG. 6 is a side elevational view of the unit of the present invention; and

FIG. 7 is a digramatic illustration of the present invention in use.

DETAILED DESCRIPTION OF INVENTION

Figure 1:
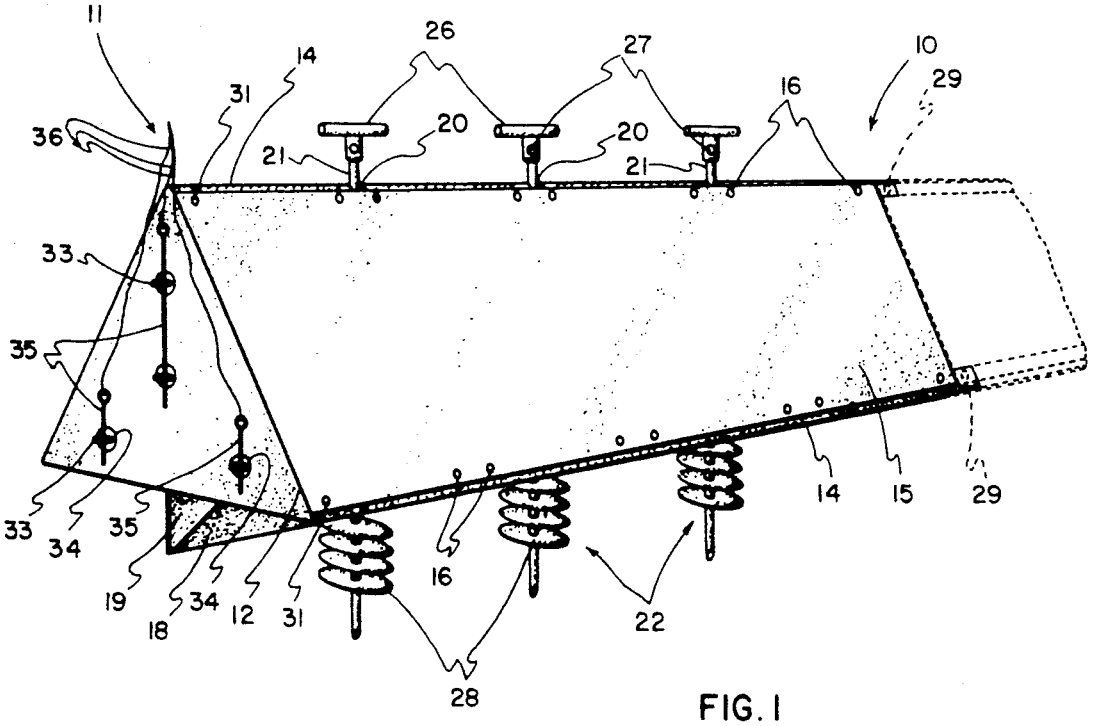
FIG. 1 is a side perspective view of the shoreline erosion control and refurbishing means of the present invention showing the end panel closed for movement to its use location.

With further reference to the drawings, the shoreline erosion control and refurbishing means of the present invention, indicating generally at 10, includes a plurality of modules indicated generally at 11 composed of a generally equilateral triangle-in-cross-section outer module 12 and generally equilateral triangle-in-cross-section inner module 13.

The two modules 12 and 13 of the present invention are so constructed that they can be shipped in compact form and can be assembled prior to use.

To accomplish the above, elongated 60° corner members 14 are provided. If the modules are constructed from recycled plastic, these corner members could be extruded.

The two side walls 15 can likewise either be extruded or molded and are generally flat, rectangular members and have openings either formed or drilled in spaced relationship along the two longer edges thereof. These members are adapted to receive corner-to-side securing means 16. These securing means can either be screws, rivets, bolts or the like. They can also be formed from either plastic or metal so long as they are impervious to rust and corrosion.

The bottom member 17 of outer module 12 has a plurality of vertical stabilizer fins 18 downwardly disposed therefrom. Strengthening gussets are provided on opposite sides at opposite ends of each of these fins. There is a gap between the fins to leave room for the shaft portion of the auger anchor as will hereinafter be described in greater detail.

The stabilizing fins 18 and their associated strengthening gussets 19 can be secured to the exterior bottom member 17 by means such as gluing or can be integrally molded thereinto.

The inner module 13 is likewise constructed from elongated corner members 14' and three side members 15' which are connected by securing means 16'.

Openings 20 are provided in the elongated corner member 14 that joins the two side members 15, this being the upper corner member when the means of the present invention is in use position.

A plurality of openings 23 are provided in bottom member 17 between the stabilizer fins 18. Each of these openings 23 is in vertical alignment with one of the openings 20 in upper member 14.

Figure 3:
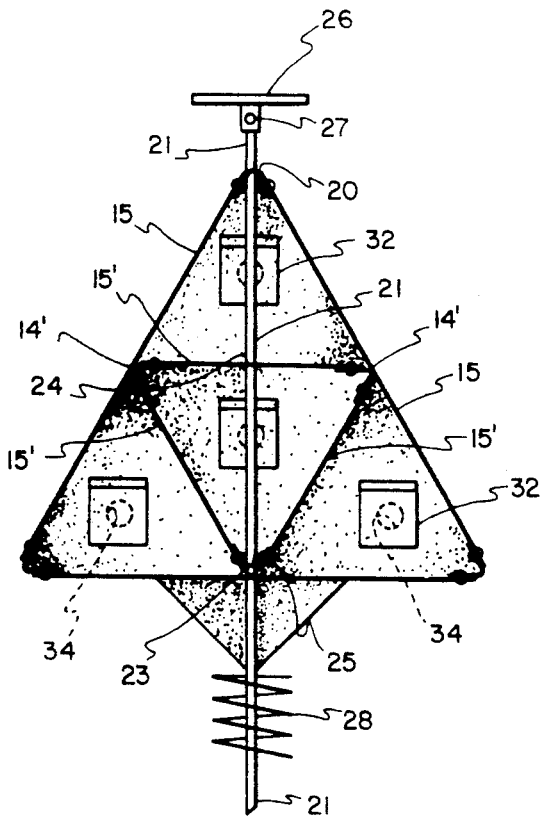
FIG. 3 is an open end elevational view of the same.
Figure 4:
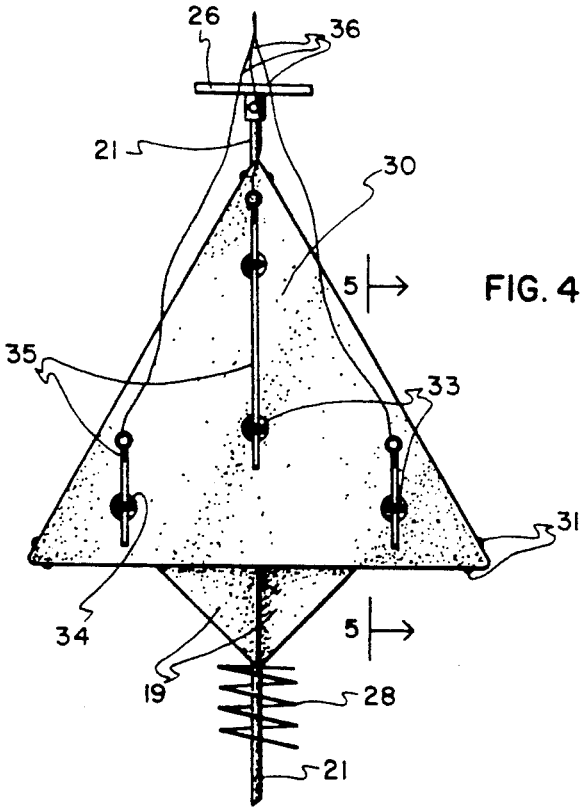
FIG. 4 is a closed end elevational view thereof.

An inner module 13 is adapted to slide into each of the outer modules 12 with one corner of the triangle-in-cross-section inner module pointing downwardly as can clearly be seen in FIG. 3.

Spaced openings 24 are provided in the horizontal side of inner module 13 and in the bottom corner member 14' thereof. These last mentioned openings are in alignment with paired openings 20 and 23.

Handle 24 is removably mounted on auger shaft 21 by securing means such as pin 25 and can be removed from such shaft. The shaft can then be passed through aligned bottom opening 23 of the outer module, the corner opening 25 of the inner module, the side opening 24 of the inner module, and the upper opening 20 of the outer module to effective lock the inner module and outer module together in the strength bracing configuration, again as shown in FIG. 3.

Helical plates or flanges are secured by weldment or other means to the end of each shaft 21 opposite handle 26. When a shaft 21 is passed through the two modules as described above, the helical plates will lie adjacent the stabilizing flanges 18 with the handle being disposed adjacent the upper corner member 14. This effectively locks the auger shaft 21 in module retaining position.

Figure 2:
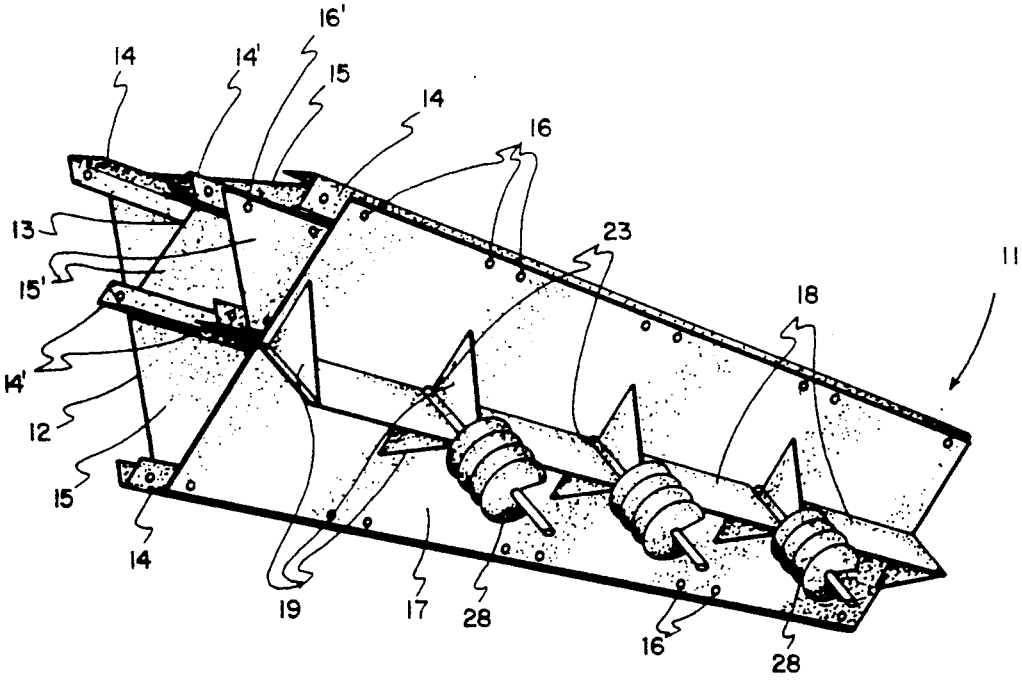
FIG. 2 is a bottom perspective view thereof.

One end of each of the control and refurbishing units 11 has the corner members projecting outwardly beyond the sides as does the inner module as can clearly be seen the FIG. 2. The opposite end of the unit has the corner members and the inner module recessed an amount equal to the outward projection on the other end. Thus it can be seen that a plurality of units can quickly and readily be slipped together, projections into recesses, and hold together by means such as unit securing means 29. These securing means are similar to securing means 16 and 16'.

Once the desired number of units 11 have been secured together by unit securing means 29, end caps 30 can be mounted to enclose the open ends of the two end units and can be secured in place by securing means 31.

Each of the end caps or plates has four openings 34 therein corresponding to the four tunnel-like longitudinal areas formed by positioning of the inner module in the outer module as seen in FIG. 3.

A flap valve 32 is provided on the inside of each of the end caps or plates 30 juxtapose to each of the four openings. The purpose of the flap valves is to allow ingress of water and sand when the shore erosion control and refurbishing means of the present invention is in use but to prevent egress thereof as will hereinafter be described in greater detail.

An eyelet-like means 33 is mounted on each of the flap valves 32 and is adapted to outwardly project through the adjacent openings 34 of cap 30.

Figure 5:
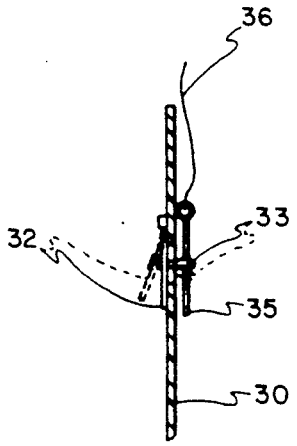
FIG. 5 is a sectional view taken through lines 5—5 of FIG. 4*b*.

Locking pins 35 are provided and are adapted to pass through eyelet 33 of each of the flap valves 32 to lock said valves closed as shown in solid lines in FIG. 5.

A flexible pull cord 36 is connected to each of the locking pins 35 so that, once the shoreline erosion control and refurbishing means of the present invention is placed in its use position, the locking pins can be removed to allow ingress of water and sand as will hereinafter be described in greater detail.

The various parts of each unit 11 is preferably packaged separately but complete with the possible exception of end caps 30 which will only require two for an entire assemblage of multiple units. Since all of the parts of each unit will lie relatively flat when unassembled, they can be placed in relatively flat, stackable cartons for shipment to the user.

Whenever it is desired to use the means of the present invention, the number of units needed to span the desired area are moved to the shoreline adjacent such area along with the desired number of end caps 30. The outer modules and inner modules are then assembled with the inner module being placed inside the outer module. The shafts 21 of the auger anchors 22 are then passed through the aligned openings 23 in the outer module, openings 25 and 24 of the inner module and, finally out opening 20 of the outer module. The handle 26 is then placed on the end of shaft 21 and secured in place by a pin 27.

Once the above is accomplished the modules are locked in place, one relative to the other. This can clearly be seen in FIG. 3.

Assembling of the units continues until the desired number have been put together and joined. The end caps 30 are then placed on opposite ends of the assemblage of units. The pins 35 are inserted into the various eyelets 33 of the various flap valves 32 to effectively seal the assemblage and make the same relatively water tight.

The assemblage 10 can now be moved into the water and floated out to a depth that is equal to approximately one and one half times the height of the unit. If the water is tidal the depth of placement would preferably be the height of the unit times one and one half at mean low tide.

Once the desired location has been reached, the pull-cords 36 are manipulated to remove the locking pins 35 from the flap valve eyelets 33 in the end caps or plates 30. Once the locking pins have been pulled as described, water and any sand, silt or other suspended matter will enter the interior of the assemblage 10 thus allowing the same to be sunk to the bottom.

Once the assemblage is resting on the bottom 44, the augers 22 with helical flanges 28 can be augered into the bottom by turning of handles 26 in a manner similar to the auger anchor used for guidewires on utility poles. As the augers are pulled tight, the fins 18 and their associated gussets 19 will be forced into the bottom of the body of water until flat bottom member 17 lies juxtapose thereto. Thus it can be seen that with the combination of auger anchors, stabilizer fins, and strengthening gussets, the assemblage of the present invention can be held securely in place.

Even after the assemblage of the present invention has been sunk and secured in place, the flap valves 32 will continue to open as currents place inward pressure thereon thus allowing sand, silt and other water born materials to ingress into the interior of such assemblage but will prevent the egress of the same since an outward moving current will automatically close such valves. Over a period of time more and more sand and silt will build into the interior of the assemblage thus further weighting the same down and giving it more holding power.

As waves 42 approach the shoreline and the upwardly sloping bottom 44, the underlying wave currents 37 will be directed upwardly by the seaward side walls or members 15 causing the wave to crest or break. As this occurs, suspended sand will be deposited adjacent said seaward wall. As this continues to reoccur, the sand will build up as indicated at 41.

After the wave breaks it moves shoreward as indicated at 38 and then, of course, will reverse and wash back seaward as indicated at 39. As this runoff approaches the shoreward side of member 15, it will wash sand back thereagainst as the water goes over the assemblage 10. As this process continues to repeat itself, sand will be moved against and deposited on the shoreward side as indicated at 40.

Once the assemblage means 10 of the present invention has been anchored as described, it will not only prevent additional erosion of the shoreline from occurring but will also actually build up the bottom and refurbish the same.

Once the sand has built up around the first assemblage enough to refurbish the shoreline, another assemblage can be placed seaward thereof and let the refurbishing process repeat itself.

From the above it can be seen that the present invention provides a shoreline erosion control and refurbishing means that is environmentally safe, is constructed from recycled material, is easy to assemble and move to its use location. Also it is extremely stable once secured to the bottom of the body of water. The means of the present invention is also highly efficient in accomplishing the desired results of both controlling erosion and causing the shoreline to be refurbished.

The terms "upper", "side", "bottom" and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A shoreline erosion control and refurbishing means comprising: a first elongated, generally equilateral triangle-in-cross-section module; a second elongated, generally equilateral triangle-in-cross-section module disposed upside down inside and said first module; at least one shaft means passing generally vertically through said modules to lock the same, one relative to the other to form a unit means; and an end plate means mounted over open ends of said first module whereby the forces of nature coming into contact with the erosion control and refurbishing means will shown normal erosion and cause an area adjacent thereto to become refurbished.

2. The means of claim 1 whereby a plurality of units can be secured together, end to end, with end plate means mounted on the open ends thereof.

3. The means of claim 1 wherein the modules forming each unit means are constructed at least partially from recycled plastic.

4. The means of claim 1 wherein an upper end of said shaft means terminates in a handle and a lower end of said shaft means terminates in an auger configuration whereby said unit means can be readily secured in its use location.

5. The means of claim 1 including a fin means downwardly protecting from a lower surface of said unit means.

6. The means of claim 5 wherein reinforcing gussets are provided for strengthening said fin means.

7. The means of claim 1 wherein at least one opening is provided through said end plate means whereby water salt, sand and other water-borne materials can ingress therethrough to an interior of said unit means.

8. The means of claim 7 wherein at least four openings are provided through each of said end plate means.

9. The means of claim 7 wherein valve means is provided to allow . ingress but to prevent egress of silt, sand and other water-borne materials.

10. The means of claim 9 wherein said valve means is a flap valve mounted on the interior of said end plate means.

11. The means of claim 9 wherein a means is provided for releasably locking said valve means closed whereby said unit can be floated to its use location and the valve means released to allow ingress of silt, sand and other water-borne materials.

12. The means of claim 11 wherein said locking means is a pin engaging an eyelet secured to a flap valve with said eyelet outwardly projecting through said opening.

13. The method of deploying a shoreline erosion control and refurbishing means comprising: forming at least one elongated, generally equilateral triangle-in-cross-section unit; passing a shaft through said unit with a handle mounted on one end and a helical plate mounted on the opposite end; moving said unit to its use location; and manipulating said handle to cause said helical plate to auger into the ground to secure said unit thereto.

14. The method of claim 13 wherein said unit is floated to its use location and valve means are opened to allow the same to fill with water and sink to the bottom prior to the manipulated step.

15. The method of claim 14 wherein said valve means are flap valves which allow ingress of silt, sand and other water-borne materials prevent the egress thereof.

16. The method of claim 13 wherein a first elongated, generally equilateral triangle-in-cross-section module is formed; a second elongated, generally equilateral triangle-in-cross-section module is formed; said second modules is disposed upside down inside said first module; and said shaft is passed vertically through said first and second module to lock the same, one relative to the other, to form said unit.

17. The method of claim 13 wherein said unit is formed at least partially from recycled plastic.

* * * * *